US005282617A

United States Patent [19]

Hong

[11] Patent Number: 5,282,617

[45] Date of Patent: Feb. 1, 1994

[54] GAME RACKET CAPABLE OF PROLONGING THEREON DWELLING TIME OF BALL

[76] Inventor: Arthur Hong, No. 96, Sec. 4, Pei-Ping Rd., Taichung City, Taiwan

[21] Appl. No.: 971,590

[22] Filed: Nov. 5, 1992

[51] Int. Cl.[5] ..... A63B 49/02

[52] U.S. Cl. ..... 273/73 G

[58] Field of Search ..... 273/73 R, 73 C, 73 E, 273/73 G, 73 D

[56] References Cited

U.S. PATENT DOCUMENTS

| | | | |
|---|---|---|---|
| 1,476,906 | 12/1923 | Santa Maria | 273/73 E |
| 1,868,238 | 7/1932 | Kleinman | 273/73 E |
| 1,912,942 | 6/1933 | Kleinman | 273/73 E |
| 2,456,023 | 12/1948 | Rosenbalm | 273/73 E |
| 3,990,700 | 11/1976 | Robinson | 273/73 E |
| 4,099,716 | 7/1978 | Haddad | 273/73 E |
| 4,102,533 | 7/1978 | Ida | 273/73 E |

FOREIGN PATENT DOCUMENTS

| | | | |
|---|---|---|---|
| 2438807 | 3/1975 | Fed. Rep. of Germany | 273/73 E |
| 2513567 | 10/1976 | Fed. Rep. of Germany | 273/73 E |
| 409075 | 2/1910 | France | 273/73 E |
| 2459667 | 2/1981 | France | 273/73 E |
| 137011 | 12/1919 | United Kingdom | 273/73 E |
| 166435 | 7/1921 | United Kingdom | 273/73 E |

OTHER PUBLICATIONS

"Strings Adjust on Hart Racket", The Sporting Goods Dealer, May 1975, p. 54.

*Primary Examiner*—William Stoll

*Attorney, Agent, or Firm*—Browdy and Neimark

[57] ABSTRACT

A game racket has a head portion with two elements extending towards each other to form two arm portions which are arranged in a V-shape configuration, with each of the two arm portions including an end portion. The end portions are merged to form a merged area which is used to form a handle. The game racket further has a suspension arm extending from the merged area towards the head portion along the longitudinal axis of the handle. The suspension arm has a yoke of a slightly accurate construction having two ends adjacent to the two elements of the head portion. The yoke and the head portion form an oval frame body for accommodating a string to form a string surface capable of prolonging thereon the dwelling time of a ball hitting the string surface.

9 Claims, 4 Drawing Sheets

GAME RACKET CAPABLE OF PROLONGING THEREON DWELLING TIME OF BALL

BACKGROUND OF THE INVENTION

The present invention relates to a game racket capable of prolonging the dwelling time of a ball so as to enhance the ball-controlling capability of the game racket.

The ball-controlling capability and the ball-striking force path of a game racket are dependent on the string tension of the game racket. In other words, if the string tension is weak, the string tends to bend more easily upon hitting a ball. As a result, the dwelling time of the ball is relatively so long as to result in a longer time that is required for the ball to bounce back. Under such circumstance, the game racket generates a relatively weak vibration by an impact of the ball, thereby making it easier for a player holding such racket to control the ball. However, such game racket has a shortcoming that the ball-striking power of the game racket is compromised. On the contrary, if the string tension of a game racket is strong, the distortion quantity of the string is relatively small at the time when the string strikes a ball. As a result, the dwelling time of the ball is so shortened as to result in a shorter time that is required for the ball to bounce back. In other words, upon hitting the ball, such game racket generates a greater vibration, which makes it difficult for a player holding such racket to control the ball. However, such game racket having a stong string tension is provided with a relatively strong ball-striking power, in view of the fact that the force path of the return stroke is correspondingly greater.

It has become obvious that the ball-controlling capability of a game racket is inversely proportional to the force path of striking a ball hitting the game racket. Some of the prior art game rackets are provided with the shock-absorbing blocks or strips, which serve to enhance the shock-absorbing capability of such game rackets. However, such shock-absorbing means are incapable of prolonging the dwelling time of a ball on the string of the game racket and are unable to improve the ball-controlling capability of the game racket.

SUMMARY OF THE INVENTION

It is, therefore, the primary objective of the present invention to provide a game racket with a stringed surface having a relatively strong string tension, which permits a longer dwelling time of a ball on the stringed face so as to enhance the ball-controlling capability of the ball.

In keeping with the principles of the present invention, the foregoing objective of the present invention is accomplished by a game racket capable of prolonging thereon the dwelling time of a ball that hits the game racket, which comprises a head portion of a horseshoe construction. The head portion has two ends which extend downwards respectively to form two arm portions arranged in a V-shaped pattern. The two arm portions merge to form a handle. The game racket of the present invention is characterized in that it comprises a suspension arm extending along the longitudinal axis of the handle from the joint of the two arm portions toward the head portion. The suspension arm comprises a yoke, which is slightly arcuate in shape and traverses the top ends of the suspension arm. The yoke has two ends that are arranged in such a manner that they are adjacent respectively to the two ends of the head portion without making contact. In other words, the game racket has an oval frame body made up of the yoke and the head portion for making a stringed surface of the game racket.

Upon hitting a ball, the stringed surface of the game racket is exerted upon by an impulse force, which is transmitted to the yoke via the longitudinal strings making up the stringed surface. As a result, the suspension arm is deformed to an extent that the distortion quantity of the longitudinal strings is so increased as to prolong the dwelling time of the ball on the stringed surface, to mitigate the vibration of the game racket, and to enhance the ball-controlling capability of the game racket. In the meantime, the strings making up the stringed surface of the game racket can be strung with a greater tension without undermining the ball-striking force path of the game racket.

DETAILED DESCRIPTION OF THE PREFERRED EMBODIMENTS

Figure 1:
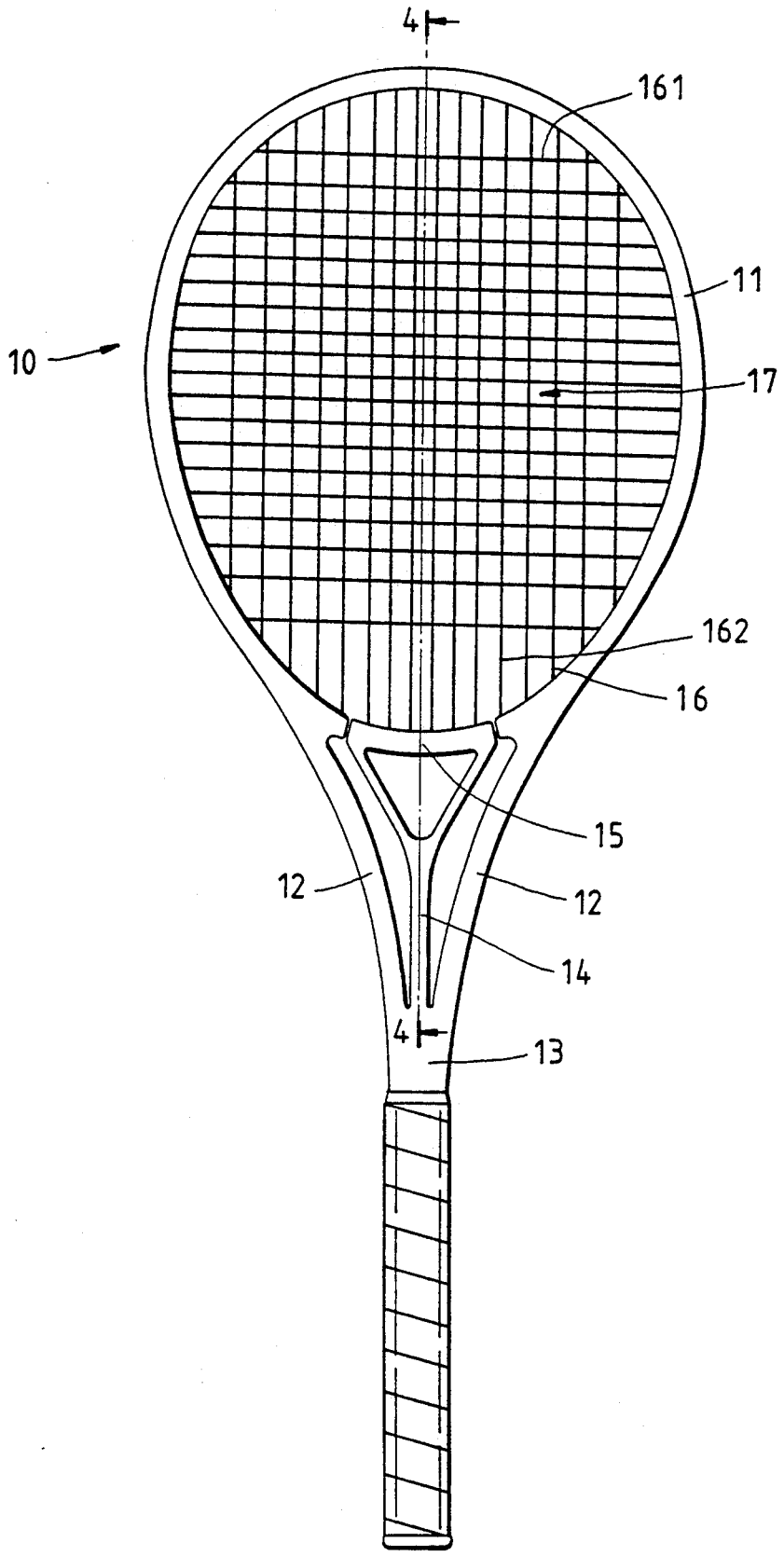
FIG. 1 shows a front elevational view of a first preferred embodiment of the present invention.
Figure 2:
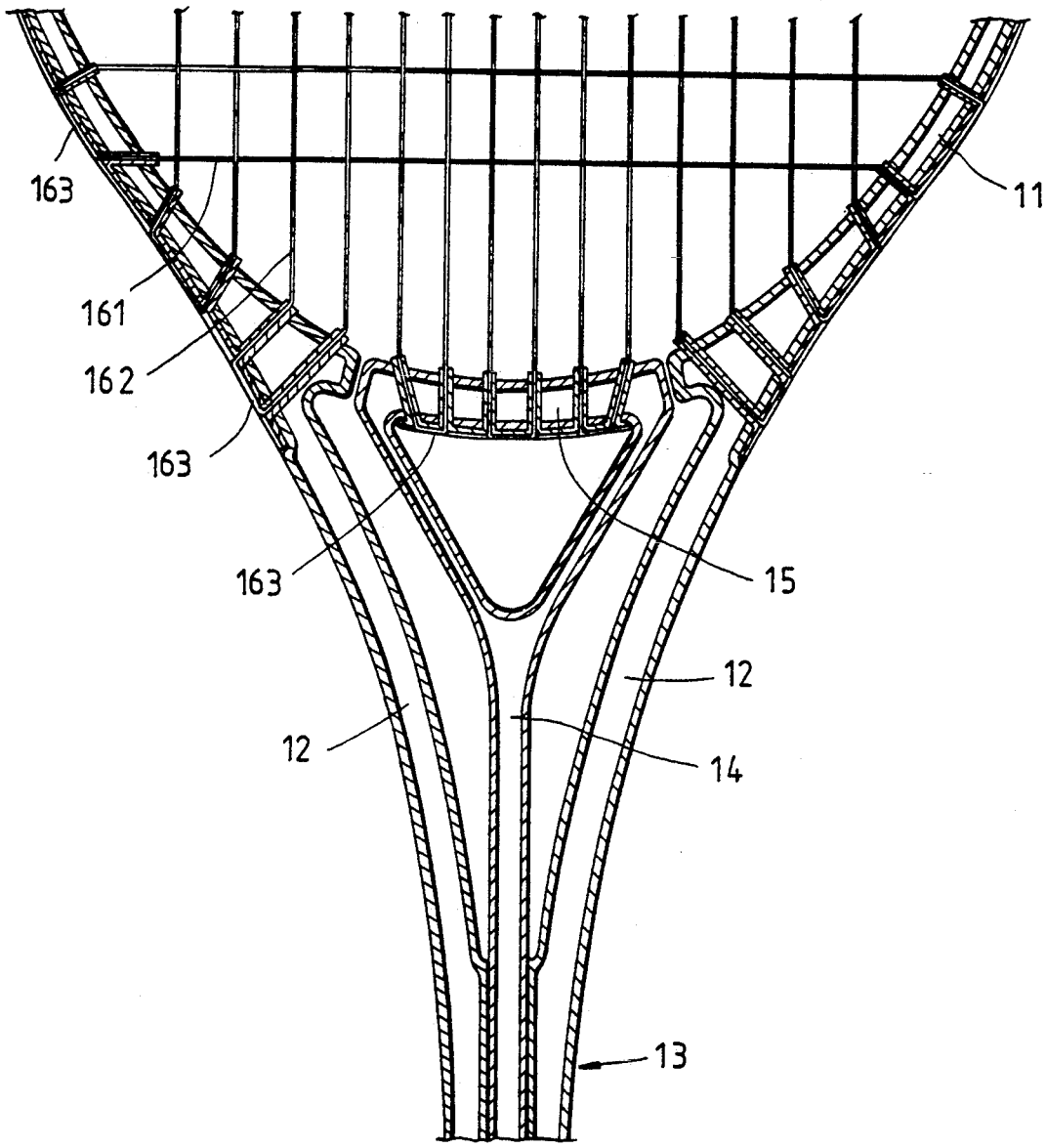
FIG. 2 is a sectional schematic view of a yoke and adjacent portions of the first preferred embodiment of the present invention, showing the way by which the strings making up the stringed surface are strung.

Referring to FIG. 1, a game racket 10 of the first preferred embodiment of the present invention is shown to comprise a head portion 11 of a horseshoe construction, two arm portions 12 extending downwards respectively from two ends of the head portion 11 in such a manner that they are arranged in a V-shaped configuration so as to merge to form a handle 13. In addition, the game racket 10 further comprises a suspension arm 14 and a voke 15. The suspension arm 14 extends along the longitudinal axis of the handle 13 from the joint of the two arm portions 12 toward the head portion 11. The suspension arm 14 of a Y-shaped construction has a yoke 15 which is slightly arcuate in shape and which has two ends that are adjacent to the two ends of the head portion 11. As a result, a distortion of the suspension arm 14 brings about an elastic distortion of the yoke 15, with the elastic distortion being perpendicular to the planar surface of the head portion 11. The game racket 10 further comprises an oval frame body, which is made up of the yoke 15 and the head portion 16 and which is used to accommodate the strings 16 so as to form a stringed surface 17 of the game racket 10. The stringed surface 17 may be constructed by a single string 16 which forms a predetermined number of horizontal string segments 161 and a predetermined number of longitudinal string segments 162. Two adjacent horizontal string segments 161 or two adjacent horizontal string segments 162 are connected by means of a connecting segment 163 located at the outer edge of the head frame. As a result, the yoke 15 has a better distortion elasticity, thanks to the connecting segments 163. It is preferable that both ends of the yoke 15, which are adjacent to the head portion 11, are devoid of the connecting segment 163, as shown in FIG. 2.

Figure 3:
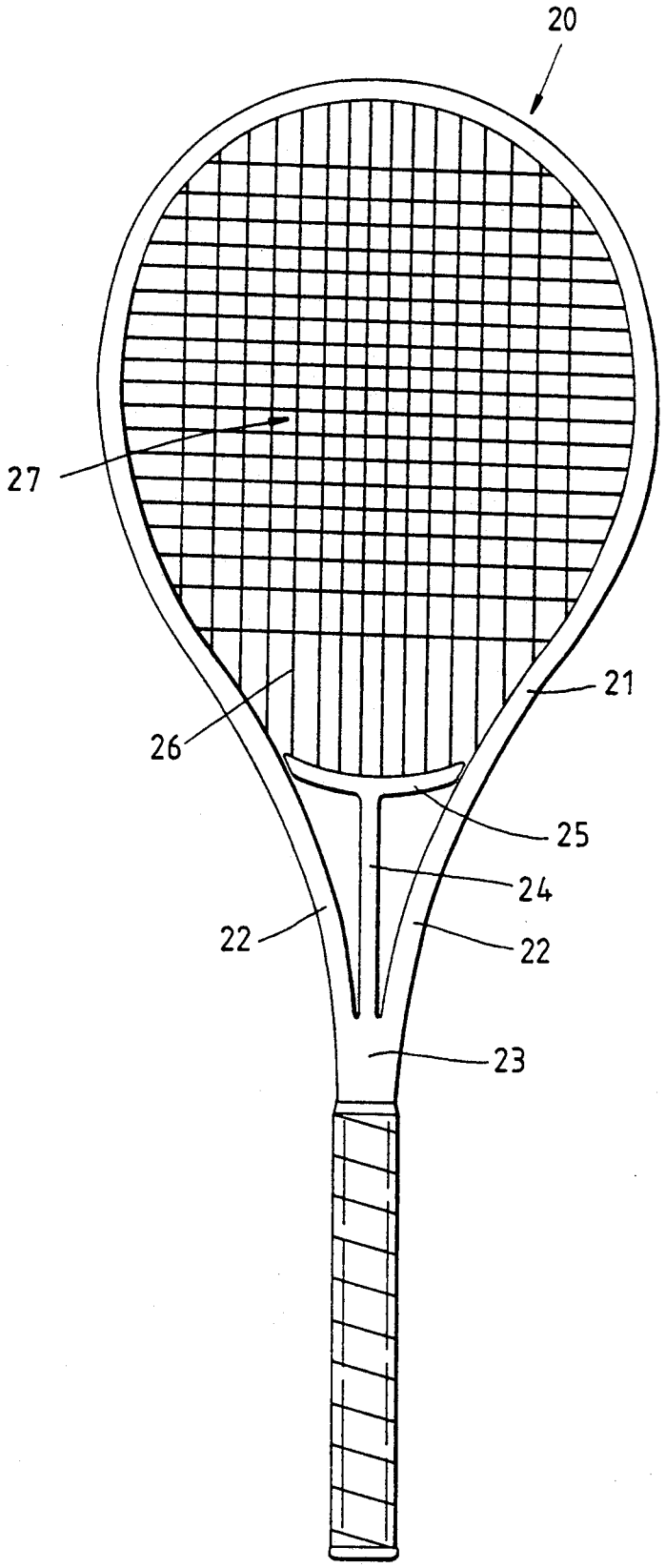
FIG. 3 shows a front elevational view of a second preferred embodiment of the present invention.

A second preferred embodiment of the present invention is illustrated in FIG. 3, in which a game racket 20 is shown to comprise a head portion 21, two arm portions 22, a handle 23, a suspension arm 24, and a yoke 25. The head portion 21 and the yoke 25 form a frame body comprising a stringed surface 27 made up of strings 26. The game racket 20 of the second preferred embodiment differs from the game racket 10 of the first preferred embodiment in that the suspension arm 24 of the second preferred embodiment is of a straight rod-shaped construction.

Figure 4:
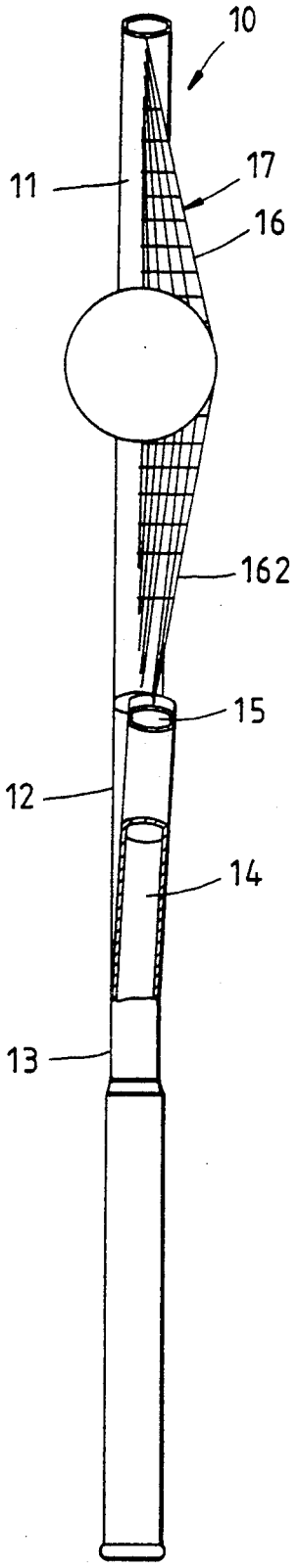
FIG. 4 is a sectional schematic view of a portion taken along the line 4—4 as shown in FIG. 1, showing the distortion of the game racket upon hitting a ball.
Figure 5:
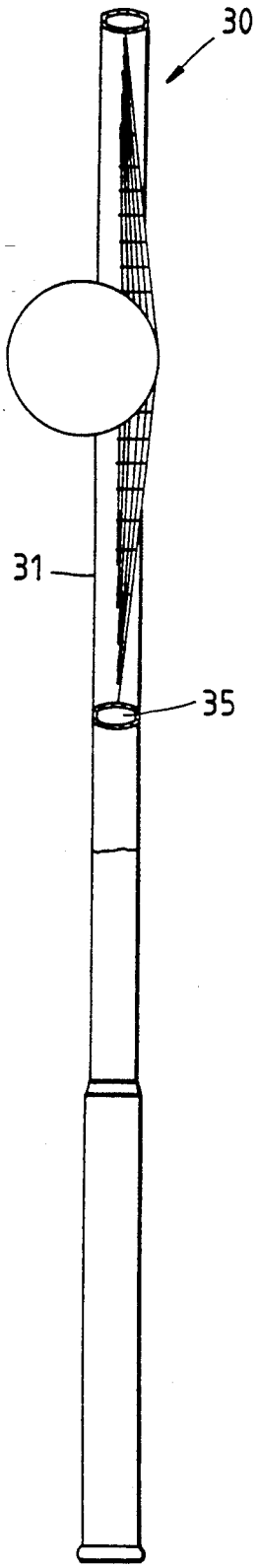
FIG. 5 is a view showing the distortion of a prior art game racket upon hitting a ball, as compared with FIG. 4.

The impact-induced distortions of the stringed surfaces of the game rackets of the present invention and the prior art are comparatively illustrated in FIGS. 4 and 5.

As shown in FIG. 4, the stringed surface 17 of the present invention is distorted by an impact of a ball hitting the stringed surface 17. Such impact force is transmitted to the head portion 11 and the yoke 15. The shock wave is then transmitted from the head portion 11 to the handle 13 via the two arm portions 12. Since the yoke 15 is not connected with the head portion 11, the impact force that is transmitted to the yoke 15 is subsequently transmitted to the suspension arm 14, which is then caused to distort. The extent of the distortion of the suspension arm 14 exceeds the distortion of the two arm portions 12, thereby bringing about an increase in the distortion of the longitudinal string segments 162. As a result, the dwelling time of the ball on the stringed surface 17 is prolonged effectively. In the meantime, the extent of the shock wave that is transmitted to the arm of a player holding the game racket 10 of the present invention is effectively mitigated. In other words, the ball-controlling capability of the game racket 10 of the present invention is therefore greatly enhanced without undermining the ball-striking force path of the game racket 10. In addition, the strings 16 of the game racket 10 of the present invention can be strung with a greater tension.

As shown in FIG. 5, a prior art game racket 30 is caused to distort by a ball hitting the stringed surface of the racket 30. In view of the fact that the head portion 31 and the yoke 35 are connected, the distortion of the game racket 30 is such that the ball-controlling capability and the ball-striking force path of the game racket 30 can not be improved simultaneously.

It must be added here that the game racket of the present invention may be made of a metal tube or a fiber-reinforced resin composite material. In addition, the suspension arms of the present invention may be made of a material that is more flexible than a material that is used to make the main frame body of the game racket of the present invention. Furthermore, the suspension arm and the main frame body of the game racket of the present invention can be made integrally or made separately. Accordingly, the present invention may be embodied in other specific forms without deviating from the spirit thereof. The present invention is therefore to be limited only by the scope of the hereinafter appended claims.

What is claimed is:

1. A game racket capable of prolonging thereon the dwell time of a ball comprising:

a head portion formed by a curved member and having two arm portions extending towards each other and arranged in a V-shaped configuration, each of said two arm portions terminating in end portions, said end portions forming a merged area from which a unitary solid handle extends along a longitudinal axis of said racket;

means for prolonging the dwell time on said racket of a ball striking said racket, comprising an elastically deformable suspension arm fixed to said head portion solely at said merged area and extending from said merged area towards said head portion along said longitudinal axis, said suspension arm having an arcuate yoke at an end thereof distal from said merged area, said yoke being two ends located adjacent to said two arm portions of said head portion;

said yoke and said head portion forming an oval frame body of said game racket accommodating a string forming a stringed surface, said yoke being unrestrained by said arm portions of said head portion except through said stringed surface.

2. A game racket as claimed in claim 1, wherein said suspension arm is of a Y-shape construction and is composed of two branched ends which are coupled respectively to said two ends of said yoke.

3. A game racket as claimed in claim 1, wherein said suspension arm and said yoke form a T-shape construction.

4. A game racket according to claim 1 wherein said suspension arm is formed of a more flexible material than said head portion.

5. A game racket according to claim 1, wherein said suspension arm is formed of a more flexible material than said head portion.

6. A game racket capable of prolonging thereon the dwell time of a ball comprising:

a head portion formed by a curved member and having two arm portions extending towards each other and arranged in a V-shaped configuration, each of said two arm portions terminating in end portions, said end portions forming a merged area from which a unitary solid handle extends along a longitudinal axis of said racket;

means for prolonging the dwell time on said racket of a ball striking said racket, comprising an elastically deformable suspension arm fixedly cantilevered to said merged area and extending from said merged area towards said head portion along said longitudinal axis, said suspension arm having an arcuate yoke at an end distal from said merged area, said yoke having two ends located adjacent and being unconnected to said two arm portions of said head portion;

said yoke and said head portion forming an oval frame body of said game racket for accommodating a string to form a stringed surface.

7. A game racket as claimed in claim 6, wherein said two arm portions are connected to each other solely at said merged area.

8. A game racket as claimed in claim 6, wherein said suspension arm is of a Y-shape construction and is composed of two branched ends which are coupled respectively to said two ends of said yoke.

9. A game racket as claimed in claim 6, wherein said suspension arm and said yoke form a T-shape construction.

* * * * *